US012729687B2

(12) United States Patent
Koch et al.

(10) Patent No.: US 12,729,687 B2
(45) Date of Patent: Sep. 8, 2026

(54) ELECTRICAL REFRIGERANT COMPRESSOR

(71) Applicant: Hanon Systems, Daejeon (KR)

(72) Inventors: Steffen Koch, Frechen (DE); Andreas Dick, Gummersbach (DE); Dirk Gutberlet, Würselen (DE)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/966,891

(22) Filed: Dec. 3, 2024

(65) Prior Publication Data

US 2025/0180021 A1 Jun. 5, 2025

(30) Foreign Application Priority Data

Dec. 4, 2023 (DE) ..... 102023133825.0

(51) Int. Cl.
*F04C 29/00* (2006.01)
*F25B 31/02* (2006.01)

(52) U.S. Cl.
CPC ..... *F04C 29/0042* (2013.01); *F25B 31/026* (2013.01); *F04C 2240/30* (2013.01); *F04C 2240/40* (2013.01); *F04C 2240/808* (2013.01)

(58) Field of Classification Search
CPC ..... F04C 29/0042; F04C 2240/30; F04C 2240/40; F04C 2240/808; F25B 31/026
See application file for complete search history.

(56) References Cited

U.S. PATENT DOCUMENTS 8,653,778 B2 2/2014 Saito et al.
2004/0052660 A1* 3/2004 Kimura ..... F04C 18/0215 417/410.3
2007/0231165 A1* 10/2007 Koide ..... F04B 27/0873 417/410.1

(Continued)

FOREIGN PATENT DOCUMENTS

DE 112014004826 B4 4/2024
JP 11992047188 4/1992

(Continued)

*Primary Examiner* — Matthew T Largi
(74) *Attorney, Agent, or Firm* — Shumaker, Loop & Kendrick, LLP; James D. Miller

(57) ABSTRACT

A refrigerant compressor which has a drive unit and a compressor unit coupled thereto, wherein the drive unit has a motor housing through which refrigerant can flow and accommodates an electric motor with a rotatable shaft, wherein the compressor unit accommodates a scroll compressor which is driven by the shaft, wherein the motor housing includes a housing wall exposed to sucked-in refrigerant and an inverter unit joined thereto and accommodates an inverter circuit board, forming a fluid-tight inverter housing, wherein the inverter circuit board has a component arrangement formed with heat-producing electronic components, in particular with at least one DC link capacitor and multiple electronic power switches, and has at least two different component heights perpendicular to the inverter circuit board and is accommodated in multiple mouldings, which are formed according to the component heights, on the refrigerant-exposed housing wall and is thermally coupled to said mouldings.

9 Claims, 10 Drawing Sheets

(56) References Cited

U.S. PATENT DOCUMENTS

Figure 1A:
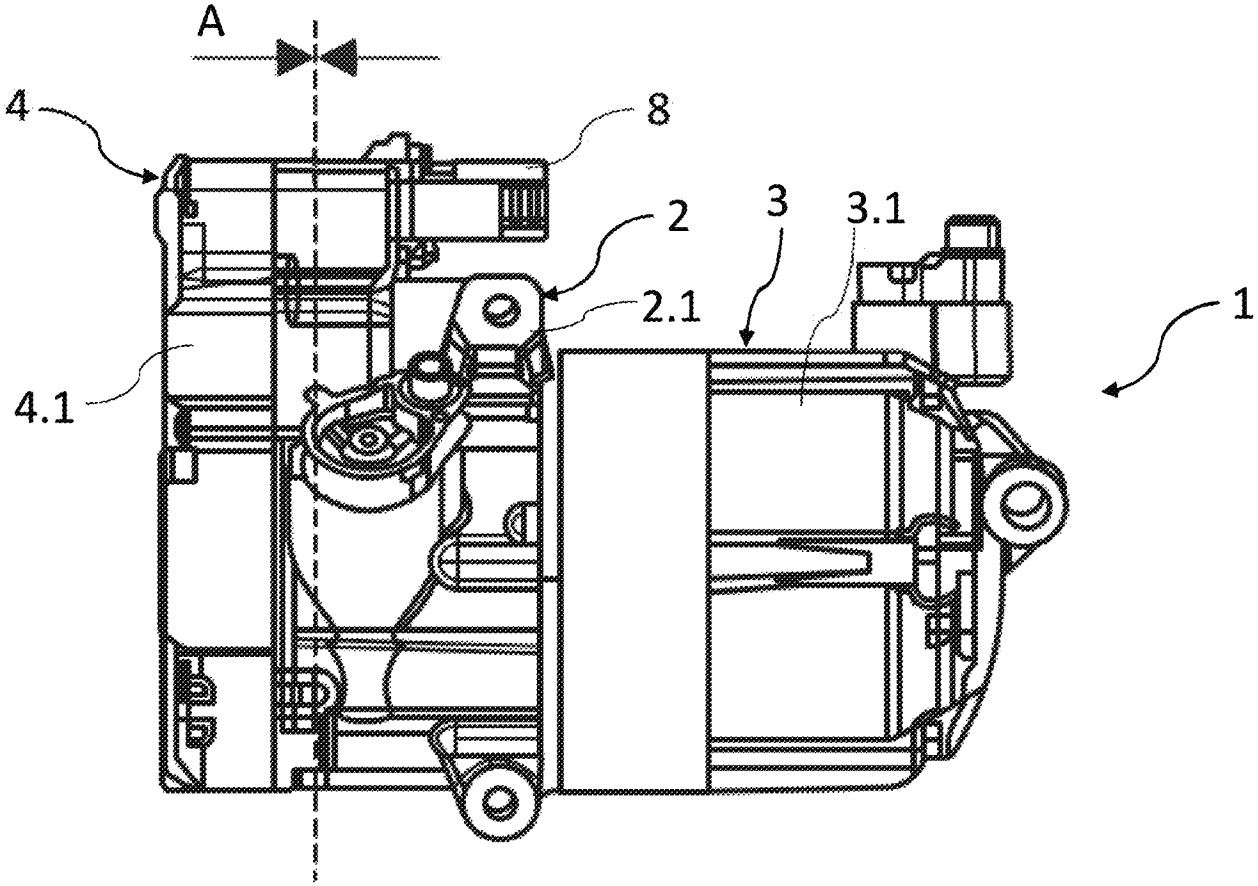
FIG. 1A PRIOR ART

| | | | | |
|---|---|---|---|---|
| 2008/0181791 | A1* | 7/2008 | Iguchi | F04C 23/008 417/366 |
| 2010/0223947 | A1* | 9/2010 | Shibuya | F04C 29/047 62/323.3 |
| 2011/0211981 | A1* | 9/2011 | Saito | F04B 39/121 417/410.1 |
| 2012/0275939 | A1* | 11/2012 | Cho | F01C 17/066 417/410.1 |
| 2015/0338143 | A1* | 11/2015 | Sakai | F04C 23/008 417/415 |
| 2016/0111942 | A1* | 4/2016 | Hattori | H02K 11/02 310/72 |
| 2017/0295662 | A1* | 10/2017 | Sakai | H05K 7/209 |
| 2018/0281565 | A1* | 10/2018 | Ito | F04C 29/047 |
| 2020/0166034 | A1* | 5/2020 | Song | H02K 5/22 |
| 2020/0227959 | A1* | 7/2020 | Yim | H02K 1/276 |
| 2020/0362843 | A1* | 11/2020 | Yim | H02M 7/48 |

FOREIGN PATENT DOCUMENTS

| | | | | |
|---|---|---|---|---|
| JP | H0447188 | U | * | 4/1992 |
| JP | 2014068511 | A | | 4/2014 |
| JP | 6723027 | B2 | | 9/2017 |
| JP | 2019002282 | A | | 9/2017 |
| KR | 20210093086 | A | * | 7/2021 |
| KR | 1020210090494 | A | | 7/2021 |
| WO | 2007086270 | A1 | | 8/2007 |
| WO | 2016056194 | A | | 4/2016 |

* cited by examiner

ELECTRICAL REFRIGERANT COMPRESSOR

CROSS REFERENCE TO RELATED PATENT APPLICATIONS

This patent application claims the benefit of and priority to German Patent Application No. DE 10 2024 129 778.6, filed on Oct. 15, 2024, and German Patent Application No. DE 10 2023 133 825.0, filed on Dec. 4, 2023, the entire contents of each of which are incorporated herein by reference for all purposes.

TECHNICAL FIELD

The invention relates to an electrical refrigerant compressor for use in a refrigerant circuit.

BACKGROUND ART

In electrical refrigerant compressors as are often used in air-conditioning systems and heat pump systems, a movable spiral (scroll) is driven by means of an electric motor. A stationary spiral that is eccentric relative to the movable spiral interacts with the movable spiral to form multiple chambers such that the chamber volume is reduced as a result of the rotation of the movable spiral, which leads to a compression of a refrigerant situated therein. The electric motor and the spirals are accommodated in a housing, which is hermetically sealed except for the openings for refrigerant. The drive unit accommodating the electric motor can be accommodated in a motor housing, and the spirals can be accommodated in a separate compressor housing part, the two housing parts being joined together during assembly. The motor electronics or an inverter for supplying the electric motor with electric current are accommodated in an inverter housing joined to the motor housing separately. Usually, a housing wall of the motor housing forms a part of the inverter housing so that a fluid-tight partition is formed between the motor housing and the inverter housing. Since the partition is exposed to refrigerant on the inside of the motor housing, through which sucked-in refrigerant flows, this housing wall can be used as a heat sink on the inverter housing side. It is therefore advantageous to arrange power-electronic components of the inverter such as electronic switches, in particular transistors (IGBTs (insulated-gate bipolar transistors), MOSFETs (metal-oxide-semiconductor field-effect transistors)) and capacitors, in particular DC link capacitors, which generate power losses in the form of heat energy during operation, on the side of the inverter housing preferably directly on the housing wall or partition that is exposed to refrigerant. As a result, the electronic components can be protected by heat dissipation, and ideal working conditions can be created. Until now, however, this arrangement has not been possible for all heat-generating electronic components, since, for example, DC link capacitors require a relatively large installation space owing to their dimensions. Therefore, DC link capacitors are arranged in the region of the electrical terminal, which is situated outside the outer circumference of the motor housing or compressor housing for space reasons. This position is unfavourable in terms of the necessary heat dissipation. Owing to this arrangement, relatively large distances must be covered for the electrical connection between the electronic components, which makes it more difficult to optimally design the interaction, for example, between the DC link capacitors and the electrical power switches, in particular IGBTs (insulated-gate bipolar transistors) and MOSFETs (metal-oxide-semiconductor field-effect transistors), in terms of the demands of electromagnetic compatibility (EMC).

Concepts of inverter circuit boards for electric motors of scroll compressors are known in which the electronic components are selected in terms of their dimensions or arrangement such that an even height profile of the electronic components results. However, such component arrangements have the disadvantage of an increased area requirement, which demands larger dimensioning of the inverter circuit board. Owing to the planar extent, the electronic components to be cooled cannot all be arranged in the limited region of the refrigerant-exposed housing wall, which would result in insufficient heat dissipation. A reduction in the distances between the components likewise does not lead to the desired result, since the risk of closely adjacent electronic components thermally influencing one another is increased.

SUMMARY

The object of the invention is therefore to propose an electrical refrigerant compressor in which improved cooling and an improvement in the EMC properties of heat-producing electronic components, in particular DC link capacitors and electronic power switches, of an inverter can be achieved.

The object is achieved by an electrical refrigerant compressor having the features shown and described herein.

An electrical refrigerant compressor is proposed which is provided for compressing a refrigerant in an air-conditioning system, in particular a vehicle air-conditioning system. The electrical refrigerant compressor has a drive unit and a compressor unit connected to the drive unit. The drive unit comprises a motor housing through which refrigerant can flow and which accommodates an electric motor with a rotatable shaft. The compressor unit accommodates a scroll compressor which can be driven by the shaft. When joined together, the motor housing of the drive unit and the compressor unit form a fluid-tight compressor housing having a refrigerant inlet and a refrigerant outlet. The refrigerant inlet is preferably formed on the motor housing of the drive unit. The motor housing comprises a housing wall, which is exposed to sucked-in refrigerant, and an inverter unit which is joined thereto and accommodates an inverter circuit board, forming a fluid-tight inverter housing. The housing wall which is exposed to refrigerant thus forms a fluid-tight partition between the motor housing and the inverter housing of the inverter unit. This housing wall is referred to below as refrigerant-exposed housing wall.

The inverter circuit board has a component arrangement which is formed with heat-producing electronic components, in particular with at least one DC link capacitor and multiple electronic power switches, and is oriented perpendicularly to the inverter circuit board. In its perpendicular orientation, the component arrangement of the heat-producing electronic components has at least two different component heights and is accommodated in multiple mouldings, which are formed according to the component heights, on the refrigerant-exposed housing wall. The component arrangement of the heat-producing electronic components is thermally coupled to the mouldings. According to the invention, all the heat-producing electronic components, in particular at least one DC link capacitor and multiple electronic power switches, are arranged facing the refrigerant-exposed housing wall and accommodated according to their component height in mouldings provided therefor, in order to ensure better heat dissipation. The heat-producing electronic components, in particular at least one DC link capacitor and multiple electronic power switches, oriented perpendicularly to the inverter circuit board plane thus form elevations, which are accommodated in the mouldings in the refrigerant-exposed housing wall. For better heat distribution perpendicular to the refrigerant-exposed housing wall, the heat-producing electronic components have different component heights.

The electronic power switches include in particular IGBTs and MOSFETs. The at least one DC link capacitor has the task of energetically coupling multiple electrical networks to one another at a common DC voltage level. The electronic power switches can also be combined in a so-called power module. This is an integrated component arrangement with a corresponding number of power semiconductors. In the context of the invention, the electronic power switches can each be understood as an integrated component arrangement in the form of a power module. It should also be mentioned that the component arrangement can also have more than six individual electronic power switches or power semiconductors. The stated number of six electronic power switches or power semiconductors relates only to the minimum number for actuating three-phase machines.

An end wall of the motor housing preferably acts as the refrigerant-exposed housing wall, and therefore the installation space for the component arrangement of the heat-producing electronic components, in particular the at least one DC link capacitor and the multiple electronic power switches, is limited to the cross section of the end wall. This requires small distances between the electronic components and an extension in height, i.e., in the perpendicular orientation to the inverter circuit board. For this reason, the component arrangement has heat-producing electronic components which form a height profile with at least two different component heights. Owing to the different component heights, the risk of closely adjacent electronic components thermally influencing one another is reduced and heat dissipation for the electronic components protruding into the depths of the mouldings is increased. It is thus essential to the invention that the heat-generating electronic components have at least two different component heights perpendicular to the inverter circuit board to allow heat dissipation via at least two planes. These planes are situated at a distance parallel to the inverter circuit board corresponding to the component height of the relevant heat-generating electronic component. A component arrangement in which heat-generating electronic components on an inverter circuit board have a substantially equal component height in only one plane does not form the subject matter of the invention. In particular the multiple electronic power switches (IGBTs, MOSFETs) and the at least one DC link capacitor thus have a substantially unequal component height perpendicular to the inverter circuit board.

It can be provided for the multiple electronic power switches (IGBTs, MOSFETs) together to have a first component height, and for the at least one DC link capacitor to have a second component height which protrudes beyond the first component height perpendicularly to the inverter circuit board. Accordingly, the moulding accommodating the at least one DC link capacitor is deeper than the moulding for the multiple electronic power switches.

The mouldings accommodating the heat-producing electronic components can be designed as recesses in the refrigerant-exposed housing wall. An inner surface of the recesses therefore consists of the material of the refrigerant-exposed housing wall, this material usually being a metal which conducts heat well. The heat dissipation of the heat-producing electronic components is promoted by the good thermal conductivity of the metal, refrigerant-exposed housing wall both at the end faces and on the sides of the heat-producing electronic components.

The refrigerant-exposed housing wall can have a separate recess for each electronic component so that each electronic component can be accommodated separately.

The individual recesses or mouldings are preferably separated by a partition. As a result, a spatial separation between the electronic components accommodated in the recesses or cut-outs is achieved. It can also be provided for multiple electronic components of the same type, for example all the electronic power switches, to be accommodated together in a single cut-out or moulding.

Advantageously, the individual recesses or mouldings are designed such that the at least one DC link capacitor and the multiple electronic power switches are each in contact with the refrigerant-exposed housing wall on at least two sides of their surface. The at least one DC link capacitor and the multiple electronic power switches can thus each be in contact at an end face with the refrigerant-exposed housing wall, wherein in each case at least one side wall of the at least one DC link capacitor and the multiple electronic power switches are in contact with a side wall of a moulding accommodating them.

It can also be provided for the at least one DC link capacitor and the multiple electronic power switches each to be accommodated form-fittingly in the mouldings in the refrigerant-exposed housing wall. In this case, the mouldings formed in the refrigerant-exposed housing wall have an inner profile which form-fittingly accommodates the elevations, protruding perpendicularly beyond the inverter circuit board, of the at least one DC link capacitor and the multiple electronic power switches. The inner profile of the recesses thus corresponds to the negative of the height profile of the component arrangement consisting of the at least one DC link capacitor and the multiple electronic power switches.

The invention optimises the power-electronic load flow in relation to the distances between the heat-producing electronic components. Thanks to the optimised positioning of the heat-producing electronic components, inductive and capacitive coupling effects are reduced. Voltage peaks and current peaks between the converter DC link and the electronic power switches are thus significantly reduced. This results in an improvement in the electromagnetic compatibility (EMC).

According to a preferred embodiment, the at least one DC link capacitor can be positioned in the region of the centre of the refrigerant-exposed housing wall, while the multiple electronic power switches are arranged in a semicircular or circular arrangement around the at least one DC link capacitor. This arrangement is advantageous when the refrigerant-exposed housing wall forms an end wall of the motor housing on which the electric motor is accommodated on the motor housing side. In this case, the sucked-in refrigerant flows around the centrally arranged electric motor during operation so that a refrigerant flow path forms in the region of the outer circumference of the end wall, which refrigerant flow path has an influence on the heat dissipation on the refrigerant-exposed housing wall on the side of the inverter housing. Inside the motor housing, therefore, a refrigerant flow path is formed which runs along the refrigerant-exposed housing wall, wherein at least the multiple electronic power switches are arranged along the course of the refrigerant flow path on the refrigerant-exposed housing wall. This is advantageous since the heat dissipation is greatest in the region of the refrigerant flow path on the refrigerant-exposed housing wall on the inverter housing side.

According to the above embodiment, in which the refrigerant flows around the electric motor arranged in the centre during operation, the course of the refrigerant flow path is pronounced on the edge of the refrigerant-exposed housing wall. Accordingly, the multiple electronic power switches can be arranged in a semicircular or circular arrangement along this refrigerant flow path, wherein the at least one DC link capacitor is situated in the middle of the circular or semicircular arrangement.

According to this particularly simple embodiment of the motor housing, the refrigerant-exposed housing wall has a motor bearing which is formed on the motor housing side of the refrigerant-exposed housing wall to accommodate the electric motor. In this embodiment, the at least one DC link capacitor is preferably arranged on the inverter housing side of the refrigerant-exposed housing wall in the region of the motor bearing formed on the motor housing side of the refrigerant-exposed housing wall. The arrangement of the at least one DC link capacitor is thus situated on the side of the refrigerant-exposed housing wall facing the inverter housing in the region of the electric motor arranged on the opposite side of the refrigerant-exposed housing wall.

According to a preferred embodiment, the motor housing has a tangential refrigerant inlet so that the sucked-in refrigerant can flow into the motor housing tangentially. This is advantageous in particular in embodiments in which the electric motor is arranged in the centre of the motor housing such that an interstice is formed around the circumference of the electric motor between an outer side of the electric motor and an inner side of the motor housing, which interstice forms a flow path for the inflowing refrigerant. Unlike a radial refrigerant inlet, with which a sucked-in refrigerant flow would bounce off the centrally arranged electric motor, the sucked-in refrigerant flows unhindered through the tangential refrigerant inlet into the interstice so that the refrigerant can flow along the refrigerant flow path without influence.

The refrigerant-exposed housing wall can be designed as a separate housing cover of the motor housing.

The refrigerant-exposed housing wall can be designed both as a part of the motor housing and as a separate housing part which contains the inverter and closes the motor housing. Also conceivable is a design in the form of a hermetically sealing motor housing and a further housing which is joined to this housing and accommodates the inverter as an inverter housing.

For the thermal coupling between the heat-producing electronic components and a surface of the refrigerant-exposed housing wall, the electronic components can be in flat contact with the refrigerant-exposed housing wall. It can also be provided for a thermal paste to be introduced between the heat-producing electronic components and a surface of the refrigerant-exposed housing wall.

The refrigerant compressor according to the invention is provided in particular for use in a refrigerant circuit of a motor vehicle.

DRAWINGS

Figure 1B:
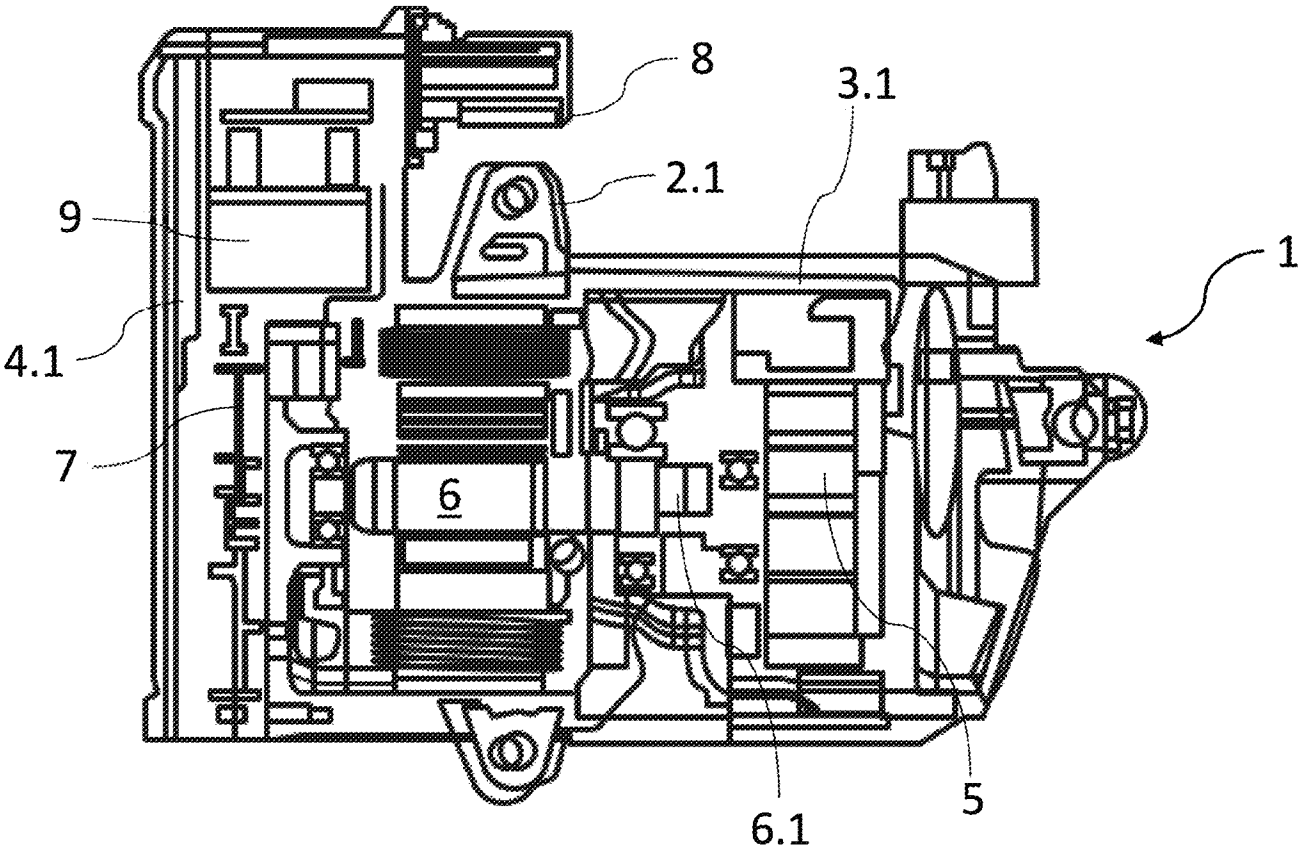
FIG. 1B PRIOR ART
Figure 1C:
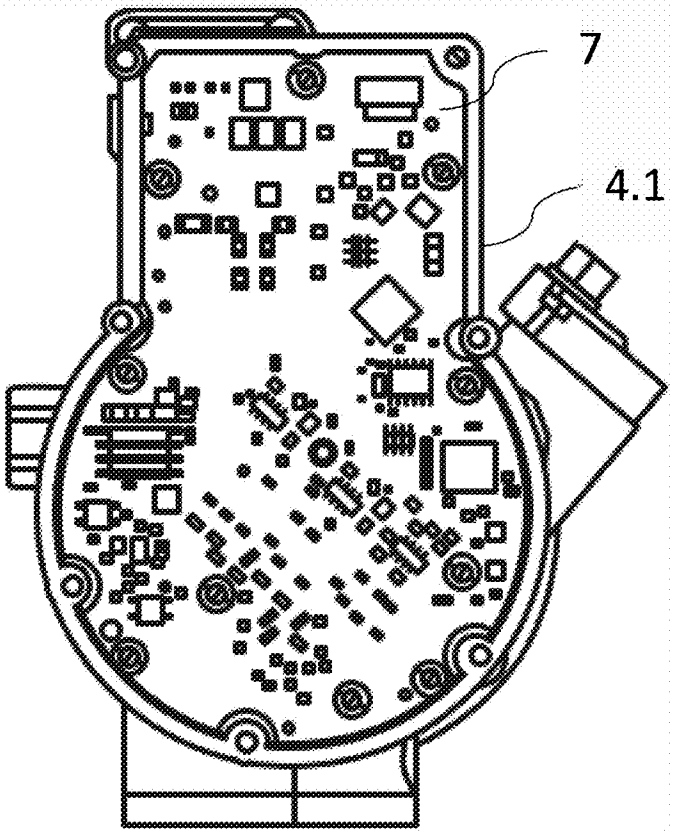
FIG. 1C PRIOR ART
Figure 2:
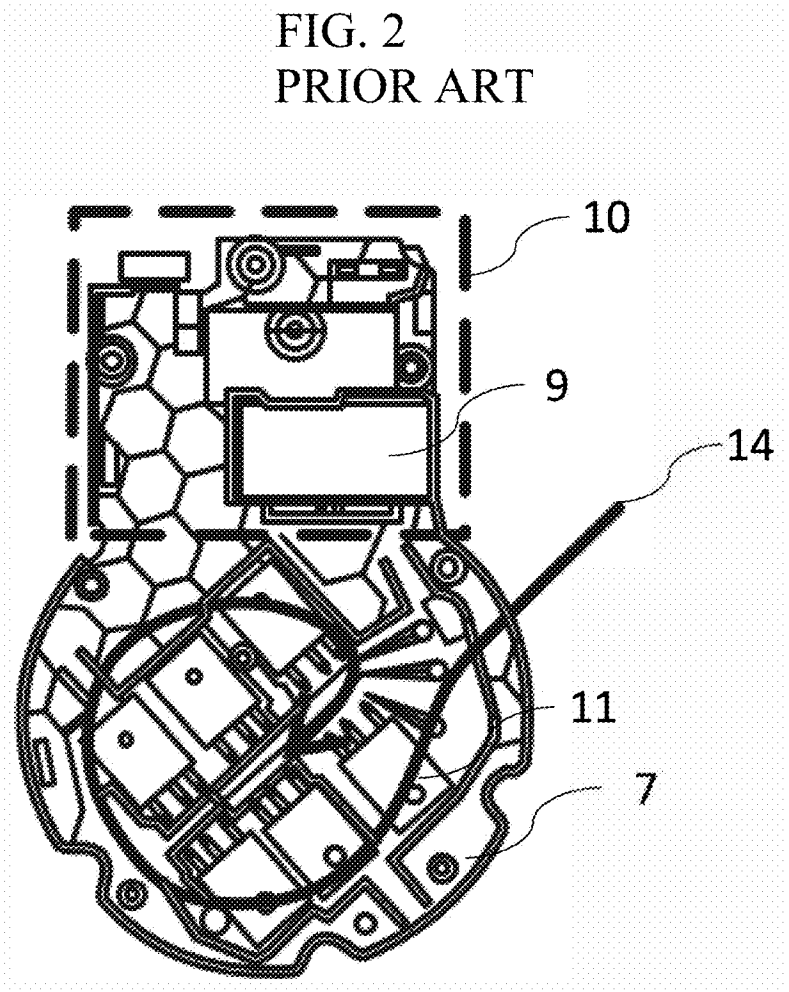
FIG. 2 PRIOR ART

Further details, features and advantages of embodiments of the invention can be found in the description of exemplary embodiments below with reference to the associated drawings. In the drawings:

FIGS. 1A to 1C: show schematic diagrams of different views of a refrigerant compressor according to the prior art, FIG. 2: shows an inverter circuit board of a refrigerant compressor according to the prior art.

Figure 3A:
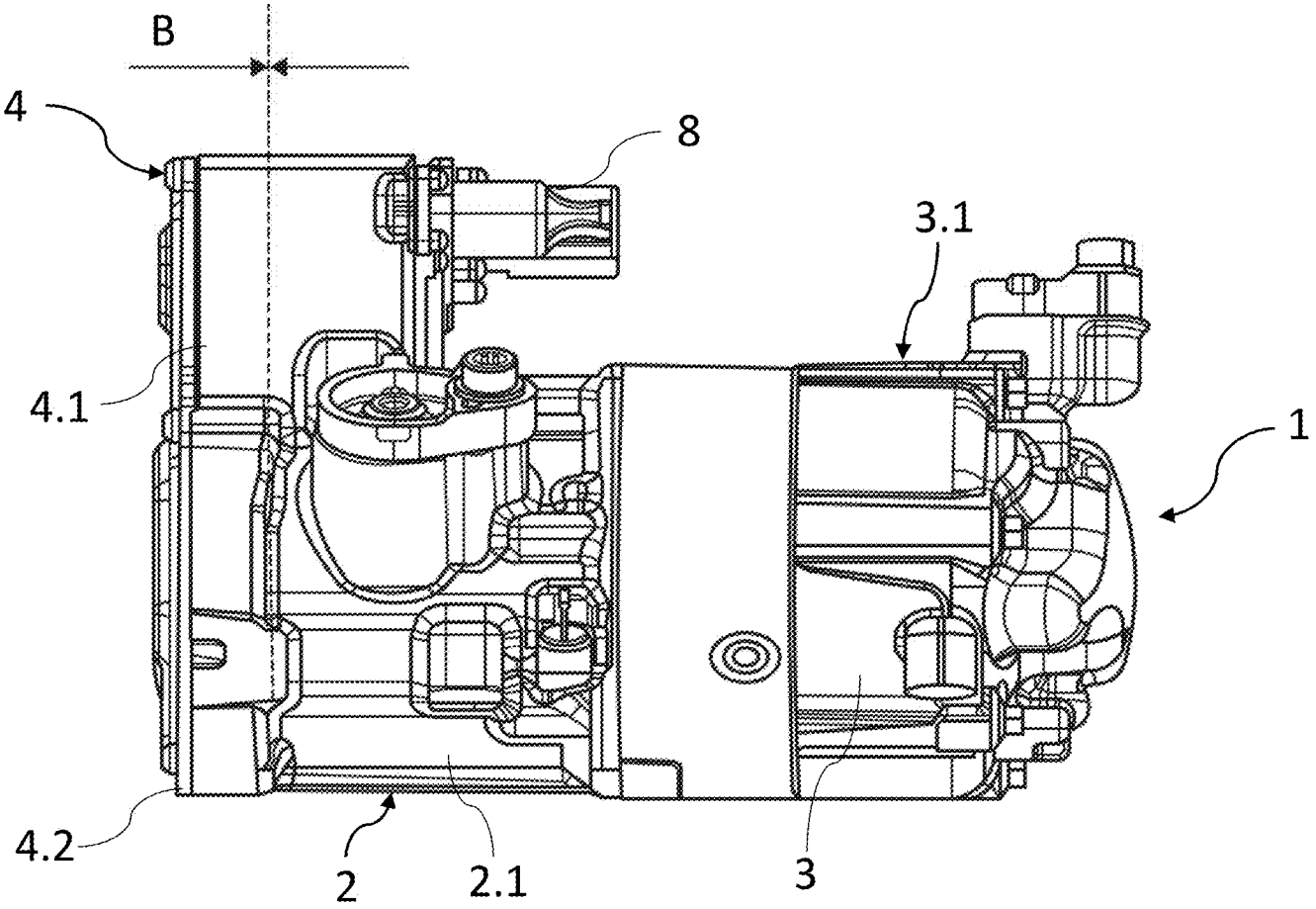
Figure 3B:
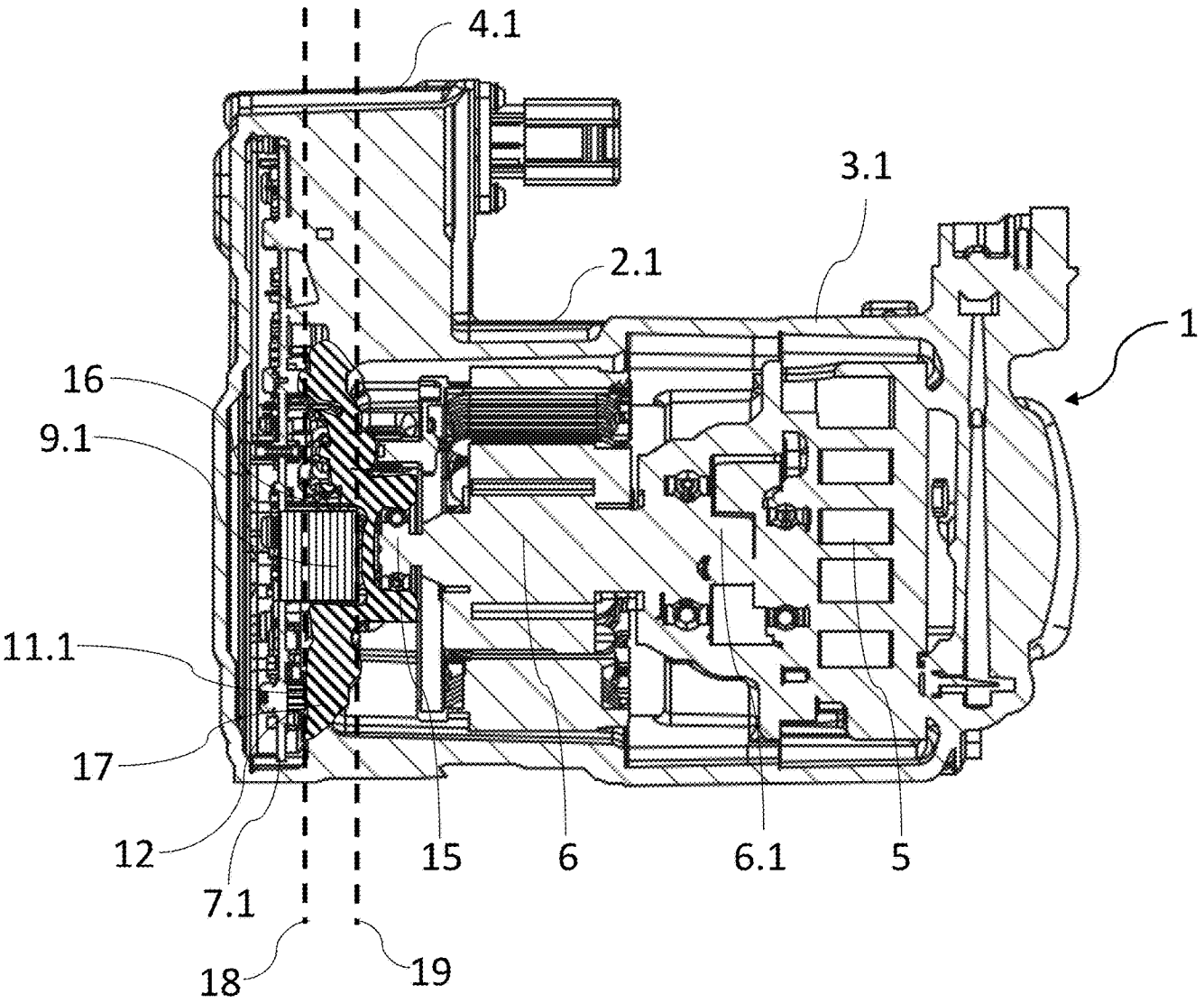
Figure 3C:
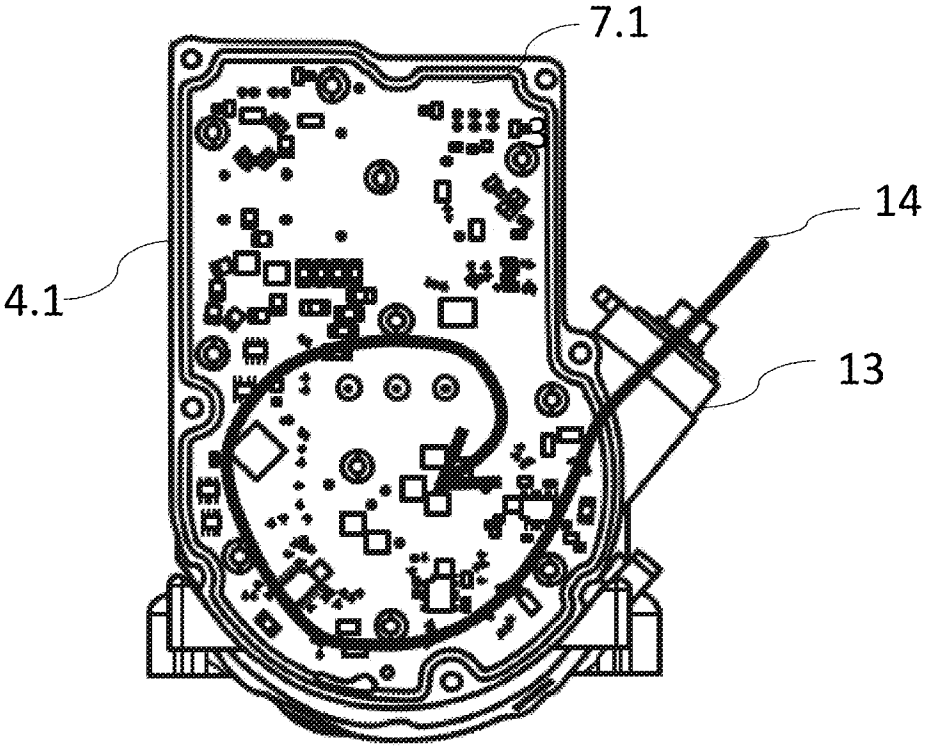
Figure 3D:
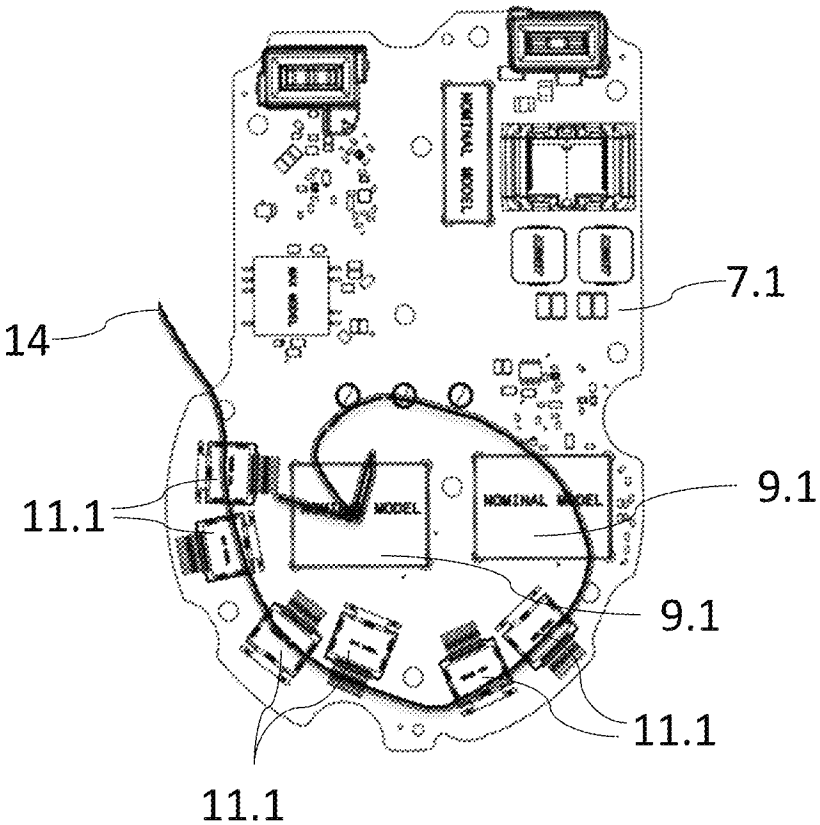
Figure 3E:
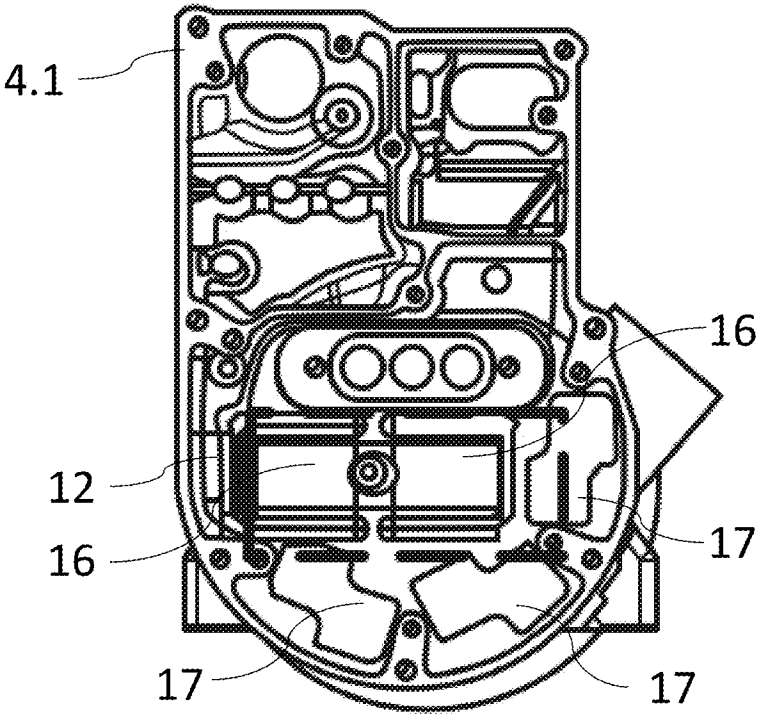
Figure 3F:
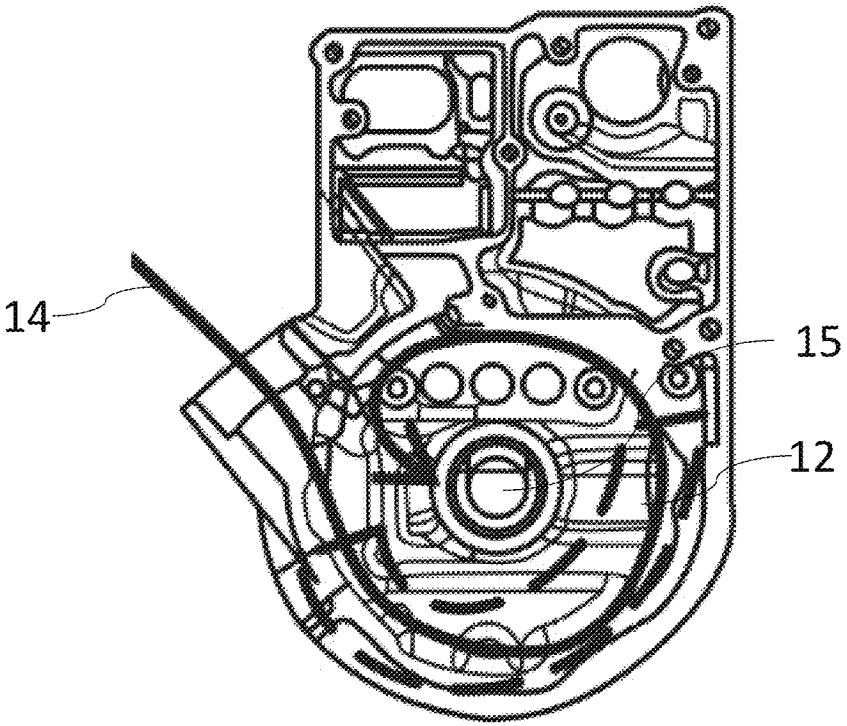

FIG. 3A: shows a schematic diagram of an exemplary embodiment of a refrigerant compressor according to the invention, FIG. 3B: shows a schematic sectional diagram of an exemplary embodiment of a refrigerant compressor according to the invention, FIG. 3C: shows a further schematic sectional diagram of an exemplary embodiment of a refrigerant compressor according to the invention, FIG. 3D: shows a schematic diagram of an exemplary embodiment of an inverter circuit board of a refrigerant compressor according to the invention, FIG. 3E: shows a schematic plan view diagram of the refrigerant-exposed housing wall of the inverter housing of a refrigerant compressor according to the invention, and FIG. 3F: shows a schematic plan view diagram of the refrigerant-exposed housing wall of the motor housing of a refrigerant compressor according to the invention.

DESCRIPTION OF AN EMBODIMENT

FIGS. 1A to 1C show schematic diagrams of different views of a refrigerant compressor according to the prior art. The directional terms axial and radial used to describe the figures relate to an orientation of the rotational axis of an electric motor which is accommodated in the refrigerant compressor. FIG. 1A shows a refrigerant compressor 1 in a longitudinal orientation with a drive unit 2 and a compressor unit 3 joined thereto. The drive unit comprises a motor housing 2.1, to which an inverter unit 4 with an inverter housing 4.1 is joined in an axial orientation in relation to an electric motor 6 (see FIG. 1B) accommodated in the motor housing 2.1. The compressor unit 3 comprises a compressor housing 3.1, in which a scroll compressor 5 (see FIG. 1B) is accommodated. The motor housing 2.1 and the compressor housing 3.1 form a fluid-tight unit with a substantially circular-cylindrical shape. The inverter housing 4.1 joined axially to the motor housing 2.1 accommodates an inverter circuit board 7 (see FIGS. 1B-1C), which extends radially around the circumference of the motor housing 2.1 so that the inverter housing 4.1 also protrudes radially beyond the circumference of the motor housing 2.1 and of the compressor housing 3.1. The housing part of the inverter housing 4.1 protruding beyond the radial circumference of the motor housing 2.1 and of the compressor housing 3.1 comprises a plug-in terminal 8 which is provided for the electrical contact or for the connection of electrical cables. Section A is shown in FIG. 1C.

FIG. 1B shows a schematic view of an axial longitudinal section of the refrigerant compressor 1 shown in FIG. 1A. Inside the refrigerant compressor 1, from left to right, the inverter circuit board 7 is arranged in the inverter housing 4.1, the electric motor 6 is arranged in the motor housing 2.1, and the scroll compressor 5 coupled via a shaft 6.1 is arranged in the compressor housing 3.1. The inverter circuit board 7 comprises a DC link capacitor 9, which is arranged in the part of the inverter housing 4.1 which protrudes radially beyond the circumference of the motor housing 2.1 and of the compressor housing 3.1.

FIG. 1C shows a view into the interior of the inverter housing 4.1 along section A, indicated with the dashed line in FIG. 1A. This is therefore an axial plan view of the inverter circuit board 7 in the inverter housing 4.1. As can be seen, the area provided by the inverter housing 4.1 is fully taken up by the shape of the inverter circuit board 7, so that an outer contour of the inverter circuit board 7 matches an inner contour of the inverter housing 4.1.

FIG. 2 shows only the inverter circuit board 7 in a plan view of the side facing the motor housing 2.1. The inverter circuit board 7 comprises a DC link capacitor 9, which is arranged in the region of the dashed line 10. The DC link capacitor 9 is thus situated outside the circumference of the motor housing 2.1. In other words, the DC link capacitor 9 is situated in the region of the housing part of the inverter housing 4.1 protruding radially beyond the circumference of the motor housing 2.1 and thus outside the region of influence of the housing wall which is used jointly between the inverter housing 4.1 and the motor housing 2.1 and can also be referred to as a partition. Within the substantially circular portion of the inverter circuit board 7, there are six electronic power switches 11, which, owing to their arrangement, are located in the region of the housing wall used jointly between the inverter housing 4.1 and the motor housing 2.1 and face said housing wall.

On the side of the motor housing 2.1, the housing wall used jointly by the inverter housing 4.1 and the motor housing 2.1 is exposed to sucked-in refrigerant. The arrow 14 indicates a possible flow path of sucked-in refrigerant in the motor housing 2.1 in relation to the relative position of the inverter circuit board 7 in the inverter housing 4.1. The electronic power switches 11 located on the refrigerant-exposed housing wall on the side of the inverter housing 4.1 are thus able to dissipate produced heat on the refrigerant-exposed housing wall. However, this does not apply to the DC link capacitor 9, which is situated in the region 10 outside the refrigerant-exposed housing wall, so that direct contact with the refrigerant-exposed housing wall for heat dissipation is not possible.

FIG. 3A shows a schematic diagram of an exemplary embodiment of a refrigerant compressor 1 according to the invention. The refrigerant compressor 1 has a drive unit 2, which has a motor housing 2.1, and a compressor unit 3, which is coupled to the drive unit 2, wherein the compressor unit 3 comprises a compressor housing 3.1 for accommodating a scroll compressor 5 (see FIG. 3B). The motor housing 2.1 and the compressor housing 3.1 have a substantially circular-cylindrical shape. An inverter unit 4 with an inverter housing 4.1 is also joined to the motor housing 2.1 of the drive unit 2. The inverter housing 4.1 protrudes radially beyond the circumference of the motor housing 2.1 and of the compressor housing 3.1. A plug-in terminal 8 formed on the inverter housing 4.1 is used for the electrical contact of an inverter circuit board 7 (see FIGS. 3B, 3C and 3D) accommodated in the inverter housing 4.1. The inverter housing 4.1 is closed fluid-tightly with a housing lid 4.2. A tangential refrigerant inlet 13 is formed on the circumference of the motor housing 2.1. From the outside, the refrigerant compressor 1 according to the invention differs only insignificantly from the refrigerant compressor 1 shown in FIG. 1A. Recurring features are therefore labelled with the same reference signs. Section B is shown in FIG. 3C.

FIG. 3B shows a schematic sectional diagram of an exemplary embodiment of a refrigerant compressor 1 and is an axial longitudinal section allowing a view into the interior of the refrigerant compressor 1. An inverter circuit board 7.1, which contains the motor electronics, is accommodated in the fluid-tight inverter housing 4.1, which is joined to the motor housing 2.1. The compressor housing 3.1 is joined to the other side of the motor housing 2.1, and a scroll compressor 5 is accommodated in the compressor housing 3.1. The scroll compressor 5 is coupled via a drive shaft 6.1 to an electric motor 6 accommodated in the motor housing 2.1. The motor housing 2.1 has an electric motor bearing 15, on which the electric motor 6 is accommodated in the interior of the motor housing 2.1 such that an interstice is formed between the outer circumference of the electric motor 6 and the radially inner circumference of the motor housing 2.1. During operation, this interstice is filled with refrigerant, wherein a refrigerant flow path for sucked-in refrigerant is formed along the interstice. The refrigerant flow path 14 (see FIG. 3C) runs along an end wall of the motor housing 2.1, and therefore this housing wall is continuously exposed to refrigerant during operation. This refrigerant-exposed housing wall 12, which is highlighted in some regions with the diagonal shading, forms a fluid-tight partition between the motor housing 2.1 and the inverter housing 4.1 joined thereto. The motor housing 2.1 and the inverter housing 4.1 thus share the refrigerant-exposed housing wall 12. The profile of the side, facing the inverter housing 4.1, of the refrigerant-exposed housing wall 12 has mouldings 16 and 17 which are provided to accommodate heat-generating electronic components of the inverter circuit board 7.1. The inverter circuit board 7.1 thus has two DC link capacitors 9.1 and six electronic power switches 11.1, which rise perpendicularly from the plane of the inverter circuit board 7.1 and extend in the axial direction. The electronic power switches 11.1 are accommodated in a moulding 17, wherein the dashed line 18 shows a first component height of the electronic power switches 11.1 perpendicular to the inverter circuit board plane. The first component height 18 corresponds substantially to the axial depth of the moulding 17 in the refrigerant-exposed housing wall 12. The two DC link capacitors 9.1 are each accommodated in a moulding 16 in the refrigerant-exposed housing wall 12. The dashed line 19 indicates a second component height which corresponds to the component height of the two DC link capacitors 9.1 perpendicular to the inverter circuit board plane. The second component height 19 furthermore corresponds substantially to the axial depth of the mouldings 16 in the refrigerant-exposed housing wall 12.

FIG. 3C shows a further schematic sectional diagram of a refrigerant compressor according to the invention. This is a sectional diagram of the inverter housing 4.1 along section B shown in FIG. 3A. The sectional diagram allows a view of the inverter circuit board 7.1 accommodated in the inverter housing 4.1. A part of the inverter circuit board 7.1 is situated in the region of the refrigerant-exposed housing wall 12. The arrow 14 indicates the flow path of a refrigerant supplied to the motor housing 2.1 via the tangential refrigerant inlet 13. It can be seen that only a part of the inverter circuit board 7.1 is assigned to the region of the refrigerant-exposed housing wall 12 or to the course of the refrigerant flow path in order to ensure heat transfer and thus heat dissipation. Therefore a part of the inverter circuit board 7.1 is not situated in the region of influence of the refrigerant-exposed housing wall 12 but in the inverter housing part of the inverter housing 4.1 which protrudes beyond the outer circumference of the motor housing 2.1.

FIG. 3D shows a schematic diagram of an exemplary embodiment of an inverter circuit board 7.1 in a plan view of the side facing the refrigerant-exposed housing wall 12 alone without the surrounding inverter housing 4.1. On this side of the inverter circuit board 7.1, the two DC link capacitors 9.1 and the six electronic power switches 11.1 are arranged in addition to further electronic components. The electronic power switches 11.1 are IGBTs or MOSFETs. Together with the six electronic power switches 11.1, which are arranged in the shape of a semicircle, oriented towards the edge of the inverter circuit board 7.1, in the region of the circular outer contour of the inverter circuit board 7.1, the two DC link capacitors 9.1 form a component arrangement of heat-generating electronic components. According to the invention, the component arrangement of the six electronic power switches 11.1 and the two DC link capacitors 9.1 is positioned on the inverter circuit board 7.1 in the region of influence of the refrigerant-exposed housing wall 12 when the inverter circuit board 7.1 is installed in the inverter housing 4.1. The six electronic power switches 11.1 and the two DC link capacitors 9.1 face the refrigerant-exposed housing wall 12. Unlike the embodiment of a refrigerant compressor 1 of the prior art shown in FIGS. 1A to 1C, the heat-generating electronic components, comprising the six electronic power switches 11.1 and the two DC link capacitors 9.1, in the invention are arranged in a compact component arrangement relative to the refrigerant-exposed housing wall 12 in order to achieve dissipation of produced heat by means of the refrigerant flow generated in the motor housing 2.1.

The six electronic power switches 11.1 extend perpendicularly out of the inverter circuit board 7.1, wherein the six electronic power switches 11.1 have equal component heights. The two DC link capacitors 9.1 likewise extend perpendicularly out of the inverter circuit board 7.1, wherein the component height of the DC link capacitors 9.1 protrudes beyond the component height of the electronic power switches 11.1, perpendicularly to the inverter circuit board 7.1. The component arrangement of the six electronic power switches 11.1 and the two DC link capacitors 9.1 thus has a height profile with two different component heights 18 and 19 (see FIG. 3B). The arrangement of the DC link capacitors 9.1 and the electronic power switches 11.1 on the inverter circuit board 7.1 is oriented towards the course of the refrigerant flow path 14 in the motor housing 2.1.

FIG. 3E shows a schematic plan view diagram of the refrigerant-exposed housing wall 12 of the inverter housing 4.1 of a refrigerant compressor 1 according to the invention. On this side, the refrigerant-exposed housing wall 12 has two mouldings 16, which are provided to accommodate the two DC link capacitors 9.1. The mouldings 16 are designed as recesses in the material of the refrigerant-exposed housing wall 12 and correspond with the two DC link capacitors 9.1 arranged on the inverter circuit board 7.1 in terms of their arrangement and dimensioning such that the DC link capacitors are accommodated in the mouldings 16 when the inverter circuit board 7.1 is installed in the inverter housing 4.1. The dimensioning of the mouldings 16 is selected such that the contact face between the mouldings 16 and the surface of the DC link capacitors 9.1 is as large as possible. In each case, at least two sides of the two DC link capacitors 9.1 are in contact with the surface of the moulding 16 accommodating them. These are in each case the end face and one side face of the cuboid DC link capacitors 9.1. To produce a thermal coupling, at least the rectangular top faces of the DC link capacitors 9.1 in the mouldings 16 are in contact with the refrigerant-exposed housing wall 12. Furthermore, it can be provided for at least one side face of the DC link capacitors 9.1 to be in contact with a surface of the mouldings 16. Preferably, the mouldings 16 are dimensioned such that they accommodate the DC link capacitors 9.1 form-fittingly. As a measure to improve the thermal coupling, a thermal paste can be introduced in each case between the DC link capacitors 9.1 and the mouldings 16 accommodating them.

Furthermore, the refrigerant-exposed housing wall 12 of the inverter housing 4.1 has three mouldings 17 to accommodate the electronic power switches 11.1. The mouldings 17 are designed as a recess in the material of the refrigerant-exposed housing wall 12 of the inverter housing 4.1 such that they accommodate the electronic power switches 11.1 when the inverter circuit board 7.1 is installed in the inverter housing 4.1. Each moulding 17 accommodates two electronic power switches 11.1. The elevations of the electronic power switches 11.1 perpendicular to the plane of the inverter circuit board 7.1 are thus accommodated virtually fully in the moulding 17. In order to promote the thermal coupling, a thermal paste can be introduced between the electronic power switches 11.1 and the mouldings 17 accommodating them. The mouldings 17 are formed along the refrigerant flow path 14 formed in the motor housing 2.1 during operation.

The mouldings 16 and 17 have no cross connection and are formed to different depths in the refrigerant-exposed housing wall 12 owing to the different component heights of the two DC link capacitors 9.1 and of the six electronic power switches 11.1. Accordingly, the mouldings 16 accommodating the DC link capacitors 9.1 are deeper than the mouldings 17 for the six electronic power switches 11.1. The further design of the refrigerant-exposed housing wall 12 is configured such that the planar inverter circuit board 7.1 is oriented perpendicularly to the rotational axis of the electric motor 6 (see FIG. 3B) when in the installed state.

Owing to the spatial separation between the DC link capacitors 9.1 and the electronic power switches 11.1 which is achieved by the mouldings 16 and 17, the risk of mutual thermal influence is low. This advantageous effect is additionally reinforced by the different component heights 18 and 19. Furthermore, a contact of side faces of the DC link capacitors 9.1 and of the electronic power switches 11.1 with the surfaces within the mouldings 16 or 17 contributes to improved heat dissipation, since the heat transfer area is enlarged overall.

FIG. 3F shows a schematic plan view diagram of the refrigerant-exposed housing wall 12 of the motor housing 2.1. The side of the refrigerant-exposed housing wall 12 facing the motor housing 2.1 is thus shown. The electric motor bearing 15 for accommodating the electric motor 6 is formed on this side.

According to the invention, the DC link capacitors 9.1 (see FIG. 3D) are arranged substantially in the region of the middle of the motor housing 2.1 opposite the electric motor bearing 15. This improves the heat dissipation to the refrigerant in comparison with the concept shown in FIGS. 1A to 1C, in which the DC link capacitor 9 is situated outside the circumference of the motor housing 2.1. Furthermore, the electronic power switches 11.1 are arranged semicircularly on the outer radius, radially close to the inner walls of the compressor suction space. The position is thus optimised to the region of maximum heat output to the refrigerant. Furthermore, the power-electronic load flow is optimised in terms of the distances between the DC link capacitors 9.1 and the electronic power switches 11.1 in order to reduce inductive and capacitive interference, which is important for sufficient electromagnetic compatibility (EMC).

The refrigerant-exposed housing wall 12 can be designed as a separate housing part, which ensures fluid-tight sealing in its arrangement between the motor housing 2.1 and the inverter housing 4.1. For fastening, a screw-fastening to the motor housing 2.1 can be provided. For this purpose, the refrigerant-exposed housing wall 12 can have corresponding screw holes.

LIST OF REFERENCE NUMERALS

1 Refrigerant compressor
2 Drive unit
2.1 Motor housing
3 Compressor unit
3.1 Compressor housing
4 Inverter unit
4.1 Inverter housing
4.2 Housing cover
5 Scroll compressor
6 Electric motor
6.1 Rotatable shaft
7 Inverter circuit board
7.1 Inverter circuit board
8 Electrical plug-in terminal
9 DC link capacitor
9.1 DC link capacitor
10 Dashed region
11 Electronic power switches
11.1 Electronic power switches
12 Refrigerant-exposed housing wall
13 Tangential refrigerant inlet
14 Arrow/refrigerant flow path
15 Electric motor bearing
16 Moulding
17 Moulding
18 First component height
19 Second component height

What is claimed is:

1. A refrigerant compressor comprising:

a drive unit; and a compressor unit coupled to the drive unit, wherein the drive unit has a motor housing through which a refrigerant can flow and which accommodates an electric motor with a rotatable shaft, wherein the compressor unit accommodates a scroll compressor which can be driven by the shaft, wherein the motor housing comprises a housing wall which is exposed to sucked-in refrigerant and an inverter unit which is joined thereto and accommodates an inverter circuit board, forming a fluid-tight inverter housing, wherein the inverter circuit board has a component arrangement which is formed with heat-producing electronic components including at least one DC link capacitor and multiple electronic power switches, and has at least two different component heights perpendicular to the inverter circuit board and is accommodated in multiple mouldings, which are formed according to the component heights, on the refrigerant-exposed housing wall and is thermally coupled to the mouldings, wherein the motor housing has a tangential refrigerant inlet configured to initially direct refrigerant along a refrigerant flow path extending around a circumference of the refrigerant-exposed housing wall within the motor housing, wherein the multiple electronic power switches are arranged in a semicircular or circular arrangement along the circumference of the refrigerant-exposed housing wall corresponding to the refrigerant flow path, wherein the at least one DC link capacitor is positioned radially inwardly of the semicircular or circular arrangement of the electronic power switches in a central region of the refrigerant-exposed housing wall, and wherein the refrigerant flow path extends along the electronic power switches prior to reaching the at least one DC link capacitor.

2. The refrigerant compressor according to claim 1, wherein the multiple electronic power switches together have a first component height, wherein the at least one DC link capacitor has a second component height which protrudes beyond the first component height perpendicularly to the inverter circuit board.

3. The refrigerant compressor according to claim 1, wherein the mouldings are designed as recesses in the refrigerant-exposed housing wall.

4. The refrigerant compressor according to claim 1, wherein the at least one DC link capacitor and the multiple electronic power switches are each in contact with the refrigerant-exposed housing wall on at least two sides of their surface.

5. The refrigerant compressor according to claim 1, wherein the at least one DC link capacitor and the multiple electronic power switches are each accommodated form-fittingly in the mouldings.

6. The refrigerant compressor according to claim 1, wherein the at least one DC link capacitor is positioned on the inverter housing side of the refrigerant-exposed housing wall in a region of an electric motor bearing formed on the motor housing side of the refrigerant-exposed housing wall.

7. The refrigerant compressor according to claim 1, wherein the refrigerant-exposed housing wall is designed as a separate housing cover of the motor housing.

8. The refrigerant compressor according to claim 1, wherein a thermal paste is introduced between the heat-producing electronic components and a surface of the refrigerant-exposed housing wall for thermal coupling.

9. A vehicle, comprising: a refrigerant circuit and the refrigerant compressor according to claim 1 provided in the refrigerant circuit.

* * * * *